US005437423A

United States Patent [19]

Sinclair

[11] Patent Number: 5,437,423

[45] Date of Patent: Aug. 1, 1995

[54] GOLF BAG SUPPORT ASSEMBLY WITH RETRACTABLE SPIKE

[76] Inventor: Richard C. Sinclair, P.O. Box 1531, Laguna Beach, Calif. 92652

[21] Appl. No.: 116,020

[22] Filed: Sep. 3, 1993

[51] Int. Cl.[6] ..... A63B 55/00

[52] U.S. Cl. ..... 248/96; 248/156

[58] Field of Search ..... 248/96, 956

[56] References Cited

U.S. PATENT DOCUMENTS

| | | | |
|---|---|---|---|
| 1,693,889 | 12/1928 | Dick | 248/96 |
| 1,926,184 | 9/1933 | Schwer | 248/96 |
| 2,633,317 | 3/1953 | Marsh | 248/96 |
| 3,075,733 | 1/1963 | Kimmel | 248/156 |
| 3,435,866 | 4/1969 | Cantwell | 150/1.5 |
| 3,593,766 | 7/1971 | Harmon et al. | 150/1.5 |
| 3,603,540 | 9/1971 | Gouge | 248/96 |
| 3,666,221 | 5/1972 | Schilz | 248/96 |
| 4,645,152 | 2/1987 | Downing | 248/96 |
| 4,691,884 | 9/1987 | Parduhn | 248/96 |

*Primary Examiner*—Leslie A. Braun
*Assistant Examiner*—Catherine S. Collins

[57] ABSTRACT

An improved double pronged golf bag support assembly has a two pronged ground engaging element slidably disposed within an elongated tubular housing for movement from a retracted position to an extended position with the pointed end of each prong extending beyond the lower end of the housing to engage the ground at two laterally separated points. The double pronged ground engaging element consists of a single metal rod bent at its approximate mid-point with its pointed ends extending parallel to one another downwardly within a tubular housing having an oval cross section. An exterior foot pedal element affixed between the prongs above the pointed ends extends outwardly through an elongated longitudinal slot in the tubular housing body so that the double pronged spike can be driven downwardly by foot pressure on the pedal against the upward force of an expandable spring having its lower end attached to the top of the spike and its upper end affixed within the upper end of the tubular housing. A hook is adjustably secured within the outer wall of the housing by a thumbscrew assembly to clamp tightly against the inner surface of a conventional golf bag at its upper rim.

8 Claims, 2 Drawing Sheets

GOLF BAG SUPPORT ASSEMBLY WITH RETRACTABLE SPIKE

FIELD OF THE INVENTION

This invention relates to golf bag support assemblies, and in particular, a golf bag support with a ground engaging retractable spike for releasably supporting the bag in a vertical position.

BACKGROUND OF THE INVENTION

Because golfers want to avoid placing their golf bag on the ground, efforts have been made to develop low cost, lightweight attachments for supporting a golf bag in an upright position, By this means, selected clubs can be easily removed and replaced during play, while permitting the golf bag to be carried by the over-the-shoulder strap.

In the past, a number of devices have been developed that employ a retractable, ground engaging spike which, when driven into the ground, stabilizes the golf bag in its upright position. Basically, such devices employ a spring loaded spike slidably engaged in a tubular housing to be driven into the ground by downward pressure on a foot pedal as descibed in connection with an initial version disclosed in U.S. Pat. No. 3,603,540 issued to Edwin George on Sep. 7, 1971, wherein a collar and strap arrangement was secured at the upper end of the tubular housing to engage the top of the bag. A somewhat improved version, as disclosed in U.S. Pat. No. 3,666,221 issued to Vincent P. Schmidt on May 30, 1972, employed a telescoping tubular support that was adjustable in length to match the height of different golf bags with an end hook at the upper end that fit into the upper open end of the bag, and a support plate affixed at the lower end of the housing extended outwardly to engage the bottom of the bag.

However, in these earlier designs, the foot pedal was attached to the spike through an elongated slot in the tubular housing. The natural tendency was for the user to place his weight on the foot pedal driving it down until it stopped by contact against the bottom edge of the slot. The downward force exerted on the housing at that point pulled downwardly on the housing body and on the attached end hook strap attachment, thus pulling the bag off vertical and making it difficult to maintain an upright position, particularly in loose or wet soil. Thus the user had to exercise care in not overdriving the spike into the ground which could be an annoying inconvenience. Moreover, the bottom edge of the elongated slot could act as a shear gradually cutting into the abutting foot pedal attachment with repeated use to weaken and eventually separate it from the spike.

In addition, the straight pin design of the spike often provided insufficient lateral support which necessitated use of a substantial base plate that added significantly to the cost and weight of the device.

In an effort to avoid these problems, a more recent design, as disclosed in U.S. Pat. No. 4,691,884 issued to A. Phillip Parduhn on Sep. 8, 1987 incorporates a winged spike configuration to enhance the ground gripping capabilities of the spike as well as the structural integrity of the pedal attached. In this design, the wing section extends outwardly through an open-ended longitudinal slot that terminates at the lower end of the tubular housing which is secured to a base plate support member. However, although the wing shaped spike provides more stable support, it is also quite a bit more difficult to engage and disengage, particularly in firmly packed soil. Since, during a typical round of golf, the spike will be operated scores of times, the increased difficulty involved in disengaging the spike can become tiresome and annoying. Moreover the increased force needed to extricate the winged spike is transmitted through the housing to the hook at the upper end of the bag causing unsightly wear and possibly tearing of the fabric.

All previous designs have never resolved the problem of the hook on the housing body sliding around the circumference of the golf bag. Heretofore, all hooks were designed to just lay over the rim of the bag. As the hook slides around, the housing body would lose its vertical position, so the golfer had to straighten the housing body each time he used the support device. This problem is aggravated by the fact that bags are produced with varying rim thickness.

Finally, a major problem of all prior golf bag support devices using a retractable spike involves the spike becoming clogged with dirt or mud during the course of play which would jam the spike inside the outer housing and render the support device useless.

SUMMARY OF THE INVENTION

The present invention provides a simple, low cost and lightweight golf bag support that employs an elongated hollow tubular housing, preferably having an oval cross-section in which a retractable spike element is slidably engaged for longitudinal movement from a retracted position within the housing to an extended position by pressure on an exterior foot pedal. The retractable spike is a two prong element formed by a single medium gauge metal rod bent at its middle so that both ends extend downwardly within the housing body. The exterior foot pedal is a heavy gauge bar permanently affixed, as by welding, to the double pronged spike to extend horizontally outward.

The tubular housing body, spike and foot pedal are configured in a way that the spike has slidable movement within the housing body, with the furthest downward movement of the spike terminating when the foot pedal abuts the ground. Hence, the spike cannot be overdriven, which thus prevents downward force on the housing from dislodging the spike or displacing the housing from the vertical position. The double pronged spike also provides the necessary lateral support so as to eliminate the need for a base plate, while also providing sufficient room within the oval cross-section of the tubular housing to allow dirt and mud to fall out of the tubular housing and therefore not jam the spike.

An expandable spring is affixed within the tubular housing at its upper end, with the other affixed to the top of the spike. The spring is expanded by downward pressure on the foot pedal to drive the spike into the ground. When the spike is disengaged from the ground by lifting the golf bag, the spring pulls upward to retract the spike back into the tubular housing.

A hook element is formed with a thumb screw in its lower base portion. It is attached to the tubular housing through an elongated slot in the top of the housing that extends downward a short distance. The hook is adjustably secured to the tubular housing so that it can clamp tightly onto the upper open end of any golf bag regardless of the thickness of its rim. The adjustment can also accomodate varying degrees of golf bag heights.

A simple buckle and strap is used to secure the lower end of the tubular housing to the base of the golf bag. A medium size rubber or neoprene washer may be affixed to the backside of the tubular housing along with the strap in order to stop or at least resist sliding of the lower portion of the housing around the base of the bag.

The support assembly of this invention thus consists of a minimum number of components, each of which can be readily fabricated and assembled to provide a lightweight, low cost and durable support structure for retaining a golf bag in an upright position during play with minimum inconvenience and effort on the part of the user.

DETAILED DESCRIPTION

Figure 1:
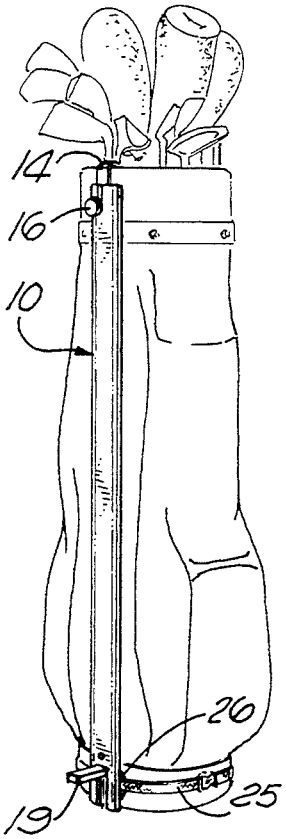
FIG. 1 is a side elevational view of a preferred form of the golf bag support structure of the present invention shown installed on the exterior of a typical golf bag with the spike in a retracted position.
Figure 2:
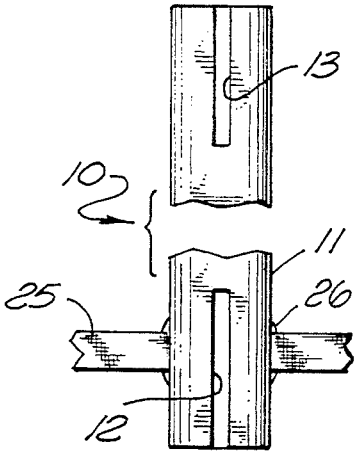
FIG. 2 is a front elevational view showing the top and bottom end portions of the tubular housing component of the support structure shown in FIG. 1, with the outer portion broken away.
Figure 7:
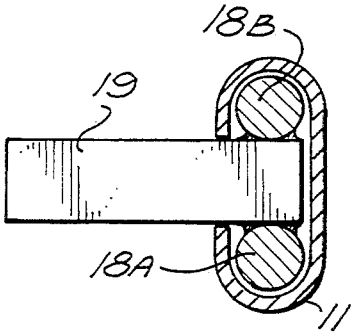
FIG. 7 is a cross-sectional view of the golf bag support structure as shown in FIG. 1 taken along the lines 5—5 of FIG. 9.
Figure 4:
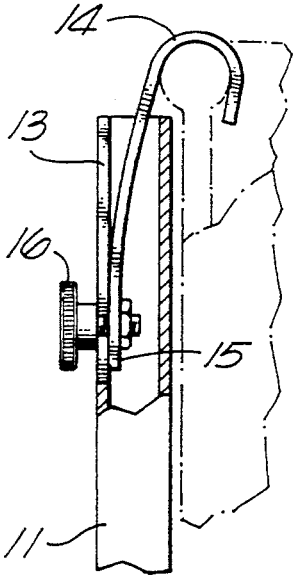
FIG. 4 is a partial side elevational view shown in partial cross-section of the upper portion of the golf bag support structure illustrated in FIG. 1 showing the hook in a clamping position.

Referring now to FIG. 1 of the drawings, the preferred form of the invention has a rigid tubular housing body 10 that is removably attachable to extend along the length of the golf bag. As shown in FIG. 2, the tubular housing body 10 consists of an elongated hollow metal tube 11, preferrably having a flattened oval cross-section as seen in FIG. 7, with a lower longitudinal slot 12 cut or otherwise formed through its outer wall and extending vertically upward from the lower end for a short distance. The upper end of the tubular housing 11 also has an elongated slot 13 cut or otherwise formed through its outer wall that extends longitudinally downward a short distance wherein a hook attachment 14 with thumb screw 16 can be adjustably secured to engage the upper rim around the open end of the golf bag as shown in FIG. 4.

Figure 3:
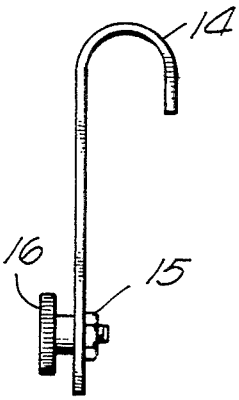
FIG. 3 is a side elevational view of the top hook components of the golf bag support structure as shown in FIG. 1.
Figure 5:
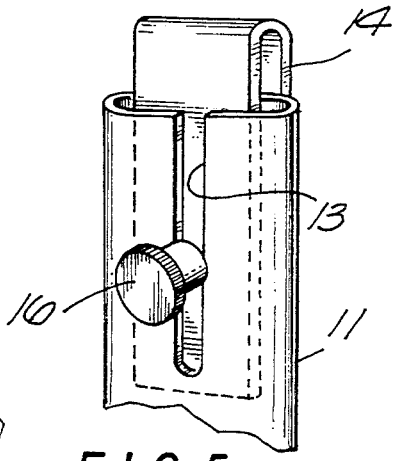
FIG. 5 is a partial front perspective view shown in partial cross-section of the upper portion of the support device illustrated in FIG. 1.

Referring now to FIG. 3, one end of the hook attachment 14 has an elongated base portion that extends into the upper end of the tubular housing along the interior surface of the outer wall with a threaded hole or affixed nut 15 for engaging a thumb screw 16. As shown in FIG. 5, as the thumb screw 16 is tightened, the hook 14 is pulled outwardly to clamp down the opposite end against the inner surface at the upper rim of the bag. In the preferred embodiment, the hollow tubular body 10 with the hook attachment 14 will be approximately three feet long, which approximates the average longitudinal dimension of most golf bags, and the longitudinal adjustability of the hook 14 along the upper slot 12 makes it adaptable to fit normal variations in length of specific bags. As illustrated in FIG. 7, the flattened oval cross-section of the hollow tubular housing 11 provides a broad, relatively flat support surface in contact with the outer bag surface to prevent or at least resist rotational movement of the housing 11 relative to the bag thus maintaining their positional relationship fixed.

Figure 6A:
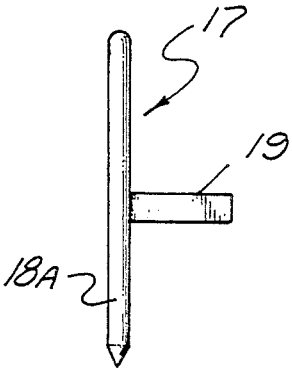
FIG. 6A is a side elevational view showing the retractable spike assembly.
Figure 6B:
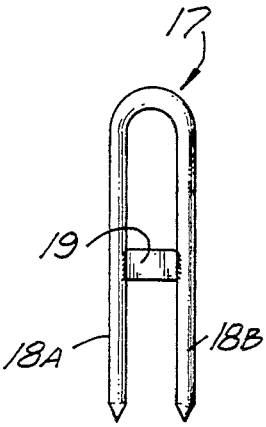
FIG. 6B is a front elevational view showing the retractable spike assembly.

As shown in FIG. 6A and 6B, the spike assembly 17 is formed by making a U-shaped bend in a rod to form two parallel elongated shafts 18A and 18B of about equal length having pointed tips at their ends to facilitate insertion into the ground. A foot pedal 19 consisting of a rectangular piece of rigid material, such as steel, is welded or otherwise affixed between the two elongated shafts 18A and 18B at an appropriate distance from the pointed ends to extend horizontally outward a short distance. As shown in FIG. 7, the U-shaped spike assembly 17 is slidably engaged along the lower elongated slot 12 to permit slidable movement.

Figure 8:
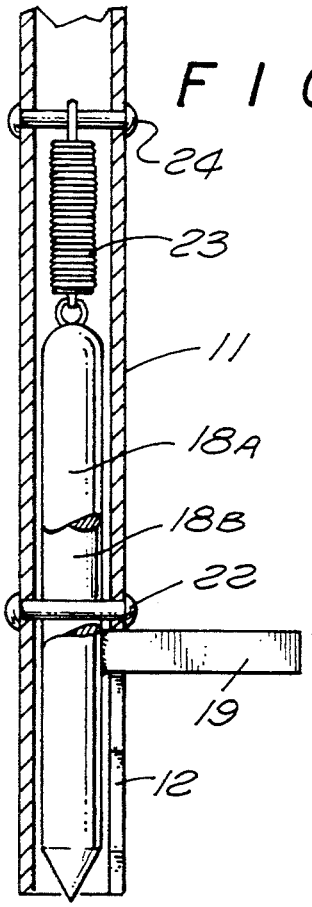
FIG. 8 is a partial elevational side view shown in partial cross-section of the bottom portion of the golf bag support structure illustrated in FIG. 1.

As best shown in FIG. 8, the lower end of the expansion spring 23 is secured around or attached to the U-bend at the upper end of the spike assembly 17, and its upper end is secured at the upper end of the tubular housing 11 around the inner shaft of a pinon rivet 24 that extends through small holes on either side of the tubular housing 11, so that the spike assembly 17 is held in a normally retracted position. A stop pin 22 also extends through holes formed on either side of the tubular housing 10 between the legs of the spike assembly 17 to limit its upward movement upon making contact with the adjacent upper surface of the foot pedal member 19.

Figure 9:
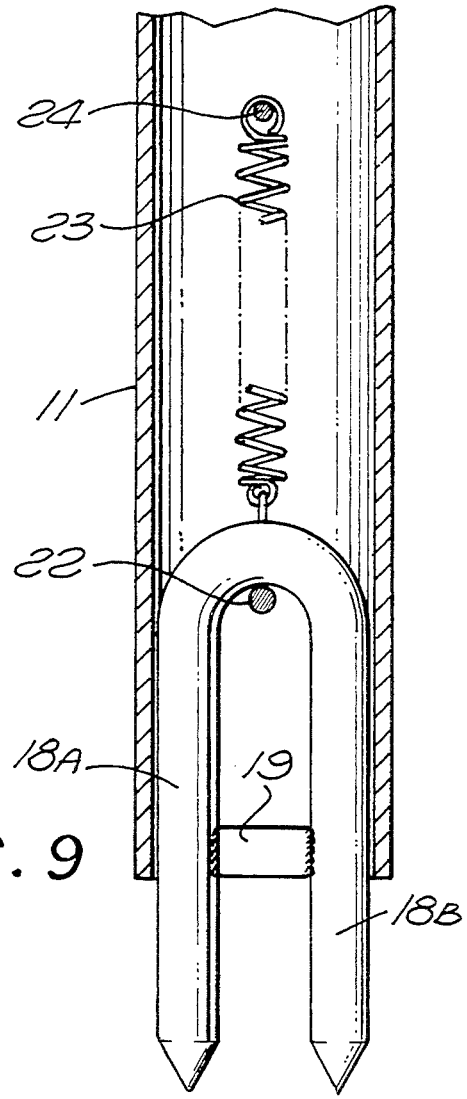
FIG. 9 is a partial elevational front view shown in partial cross-section of the bottom portion of the support structure illustrated in FIG. 1 and 7 with the spike shown in the extended ground engaging position.

Also, as shown in FIG. 9, when the spike assembly 17 is in its fully depressed position, the stop pin 22 comes into contact with the U-bend at the upper end of the spike assembly 17 to keep it from being overextended and coming out of the tubular housing 11.

Figure 10:
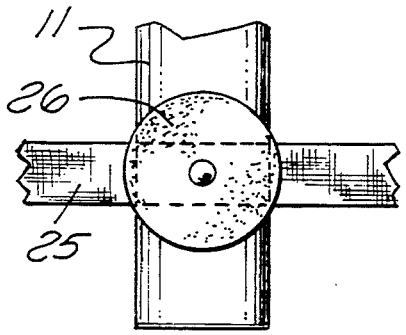
FIG. 10 is a partial rear elevational view in partial cross-section of the lower tubular housing showing the strap, buckle and washer assembly.

As shown in FIG. 1, the tubular housing body 10 is secured at its bottom end to the golf bag by a conventional strap and buckle assembly 25 that surrounds the base of the bag. Referring now to FIG. 10, the strap 25 is affixed to the back outer surface of the tubular housing 11 using a fastener, such as a rivet, to extend outward on either side. A flat rubber or neoprene washer 26 can be affixed to overlie the point where the strap 25 attaches to the back of the tubular housing 11 to contact the adjacent surface of the bag so as to resist sideways slippage of the lower end of the housing body 10 around the body of the bag, thus maintaining the vertical alignment of both.

Figure 11:
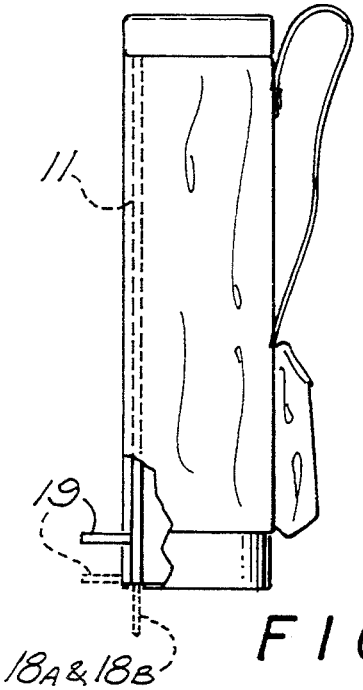
FIG. 11 Illustrates an alternative form of the invention whereby the support structure is permanently affixed as an integral part of the golf bag itself.
Figure 12:
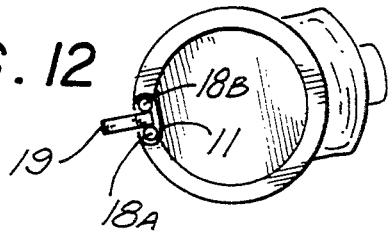
FIG. 12 is a bottom view of the alternative form of the invention.

As shown in FIG. 11 and 12, the golf bag support device can alternatively be permanently affixed within a golf bag. The upper and lower portion of the tubular housing 11 can be secured by rivets to extend along the inner surface of the golf .bag to eliminate the need for a hook assembly 14 and strap 25 but still incorporate all the benefits of the tubular housing 11 and double pronged spike assembly 17. In that case, the golf bag will be formed with a lower longitudinal slot to permit upward and downward travel of the foot pedal that extends outwardly and will also have a bottom opening for the ground engaging retractable spike.

What is claimed is:

1. A golf bag support assembly comprising:

a rigid tubular housing having an elongated longitudinal slot at its lower end;

a double pronged elongated spike slidably disposed longitudinally within said housing, said spike having first and second prongs extending downwardly and spaced apart, parallel relationship; and a foot pedal rigidly affixed intermediate the ends of said spike to extend radially outward from said spike through said slot; and attachment means for securing said housing to a golf bag having an upper rim surrounding a top opening for receiving golf clubs to extend along its length.

2. The golf bag support assembly of claim 1 wherein:

said double pronged spike consists of an elongated rod having a point at each end and a one hundred and eighty degree bend approximately equidistant the ends, said rod being disposed within said tubular housing with the pointed ends extending downwardly to form said prongs at the lower end of said housing and, said foot pedal consists of a rigid metal bar affixed to adjacent portions of said rod at an intermediate point between said bend and said pointed ends.

3. The golf bag support assembly of claim 1 or claim 2 wherein:

said attachment means included a clamping hook disposed at the upper end of said housing for engaging the upper rim of said golf bag and a strap assembly for securing the lower end of said housing to the base of said golf bag.

4. The golf bag support assembly of claim 3 wherein:

said clamping hook has an elongated base section that extends into the upper end of said housing and a thumb screw threadably engaged by said base section to releasably secure said base section within said housing.

5. The golf bag support device of claim 2 wherein:

said rigid tubular housing has an oval cross-section for slidable engaging the adjacent portions of said metal rod extending downwardly from either side of said bend.

6. The golf bag support assembly of claim 4 wherein:

said rigid tubular housing has an elongated slot at its upper end for slidably engaging said thumbscrew to permit longitudinal adjustment of said clamping hook to engage the upper rim of said bag.

7. The golf bag support assembly of claim 1 or claim 2 further comprising:

an expansion spring disposed within said tubular housing with its lower end affixed to the upper end of said double pronged spike and with its upper end secured within said tubular housing above said double pronged spike to be expanded by downward pressure exerted on said foot pedal in driving said double pronged spike downwardly to engage the ground.

8. The golf bag support device of claim 1 or claim 2 wherein:

said rigid tubular housing consists of upper and lower portions secured within said golf bag against the interior surface.

* * * * *